US011055995B2

(12) United States Patent
Israelsson

(10) Patent No.: US 11,055,995 B2
(45) Date of Patent: Jul. 6, 2021

(54) ARRANGEMENT AND METHOD FOR PROVIDING ADAPTATION TO QUEUE LENGTH FOR TRAFFIC LIGHT ASSIST-APPLICATIONS

(71) Applicant: Volvo Car Corporation, Gothenburg (SE)

(72) Inventor: Erik Israelsson, Gothenburg (SE)

(73) Assignee: Volvo Car Corporation, Gothenburg (SE)

( * ) Notice: Subject to any disclaimer, the term of this patent is extended or adjusted under 35 U.S.C. 154(b) by 592 days.

(21) Appl. No.: 15/489,098

(22) Filed: Apr. 17, 2017

(65) Prior Publication Data

US 2017/0309176 A1 Oct. 26, 2017

(30) Foreign Application Priority Data

Apr. 22, 2016 (EP) ..... 16166512

(51) Int. Cl.
*G08G 1/00* (2006.01)
*G08G 1/0967* (2006.01)
(Continued)

(52) U.S. Cl.
CPC ..... *G08G 1/096775* (2013.01); *G08G 1/0112* (2013.01); *G08G 1/08* (2013.01); *G08G 1/09626* (2013.01); *G08G 1/096716* (2013.01)

(58) Field of Classification Search
CPC ..... G08G 1/096775; G08G 1/09626; G08G 1/096716; G08G 1/0112; G08G 1/08
(Continued)

(56) References Cited

U.S. PATENT DOCUMENTS 5,864,305 A * 1/1999 Rosenquist ..... G08G 1/096716 340/905
6,188,778 B1 * 2/2001 Higashikubo ..... G08G 1/04 340/934
(Continued)

FOREIGN PATENT DOCUMENTS

CN 1448886 A 10/2003
CN 1971655 A 5/2007
(Continued)

*Primary Examiner* — Kerri L McNally
*Assistant Examiner* — Thang D Tran
(74) *Attorney, Agent, or Firm* — Snyder, Clark, Lesch & Chung, LLP

(57) ABSTRACT

A system and method relate to adapting traffic light assist applications of connected road vehicles to queue lengths at intersections having connected traffic lights. Each vehicle is arranged to: communicate to back-end logic a position thereof; and determine, using sensor data from sensors thereof, if a vehicle is located within, or if it is the last vehicle ($V_n$) in the queue (11). If the vehicle is in the que, the length ($l_{qv}$) of the queue (11) from that vehicle (3) up to the traffic light (6) is determined. If the vehicle is the last vehicle ($V_n$) in the queue, traffic light assist applications of vehicles approaching that traffic light are adapted to the determined length ($l_{qtot}$) of the entire queue.

15 Claims, 3 Drawing Sheets

(51) Int. Cl.
*G08G 1/01* (2006.01)
*G08G 1/08* (2006.01)
*G08G 1/0962* (2006.01)

(58) Field of Classification Search
USPC ..... 340/932
See application file for complete search history.

(56) References Cited

U.S. PATENT DOCUMENTS 6,516,273 B1 * 2/2003 Pierowicz ..... G08G 1/16 701/301
7,515,065 B1 * 4/2009 Bygrave ..... G08G 1/0965 340/901
7,973,674 B2 * 7/2011 Bell ..... G08G 1/161 340/901
8,781,716 B1 * 7/2014 Wenneman ..... G08G 1/0129 701/118
9,153,128 B2 * 10/2015 Holzwanger ..... G08G 1/096
2002/0077742 A1 * 6/2002 Mintz ..... G08G 1/01 701/117
2002/0082767 A1 * 6/2002 Mintz ..... G08G 1/0133 701/117
2005/0105733 A1 * 5/2005 Mihcak ..... G06F 21/16 380/262
2008/0012726 A1 * 1/2008 Publicover ..... G08G 1/095 340/932
2008/0094250 A1 * 4/2008 Myr ..... G08G 1/04 340/909
2008/0204277 A1 * 8/2008 Sumner ..... G08G 1/08 340/910
2009/0224942 A1 * 9/2009 Goudy ..... G08G 1/096783 340/905
2009/0299857 A1 * 12/2009 Brubaker ..... G06Q 30/0247 705/14.66
2009/0322561 A1 * 12/2009 Morioka ..... G08G 1/08 340/907
2010/0079306 A1 * 4/2010 Liu ..... G08G 1/01 340/909
2010/0106356 A1 * 4/2010 Trepagnier ..... G01S 17/023 701/25
2010/0317420 A1 * 12/2010 Hoffberg ..... G06Q 30/0207 463/1
2011/0043378 A1 * 2/2011 Bailey ..... G08G 1/07 340/917
2011/0095908 A1 * 4/2011 Nadeem ..... B60H 3/00 340/905
2011/0205086 A1 * 8/2011 Lamprecht ..... G08G 1/08 340/928
2012/0022776 A1 * 1/2012 Razavilar ..... G08G 1/09675 701/482
2012/0065871 A1 * 3/2012 Deshpande ..... G08G 1/0112 701/118
2012/0265874 A1 * 10/2012 Hoh ..... G06Q 10/02 709/224
2013/0041573 A1 * 2/2013 Ochi ..... G01S 13/345 701/117
2013/0076538 A1 * 3/2013 Uno ..... G08G 1/096716 340/905
2013/0151135 A1 * 6/2013 Aubrey ..... G08G 1/0116 701/118
2013/0342368 A1 * 12/2013 Nathanson ..... G08G 1/0965 340/903
2014/0004865 A1 * 1/2014 Bhargava ..... H04W 40/12 455/445
2014/0046509 A1 * 2/2014 Otake ..... G08G 1/095 701/2
2014/0046581 A1 * 2/2014 Ota ..... G08G 1/096716 701/408
2014/0149029 A1 * 5/2014 Sakakibara ..... G08G 1/0133 701/118
2014/0210646 A1 * 7/2014 Subramanya ..... G06K 9/00812 340/928
2014/0266798 A1 * 9/2014 Witte ..... G08G 1/0112 340/907
2014/0278052 A1 * 9/2014 Slavin ..... G08G 1/0129 701/400
2015/0100179 A1 * 4/2015 Alaniz ..... G06F 3/012 701/1
2015/0109147 A1 * 4/2015 Stahlin ..... G08G 1/04 340/907
2015/0120175 A1 * 4/2015 Vahidi ..... G08G 1/0141 701/119
2015/0310738 A1 * 10/2015 Karacan ..... G08G 1/0112 701/117
2016/0019783 A1 * 1/2016 Gao ..... G08G 1/052 340/916
2016/0019784 A1 * 1/2016 Peri ..... G08G 1/017 340/917
2016/0057335 A1 * 2/2016 Pisz ..... G08G 1/09675 348/149
2016/0148511 A1 * 5/2016 Shibata ..... G08G 1/162 701/119
2016/0150070 A1 * 5/2016 Goren ..... H04W 4/029 455/404.2
2016/0155327 A1 * 6/2016 Schlienz ..... G08G 1/07 340/907
2016/0210852 A1 7/2016 Buchholtz et al.
2016/0231746 A1 * 8/2016 Hazelton ..... G01S 13/867
2017/0053529 A1 * 2/2017 Yokoyama ..... G08G 1/081
2017/0124868 A1 * 5/2017 Bhat ..... G08G 1/09623

FOREIGN PATENT DOCUMENTS

CN 101655380 A 2/2010
CN 102024323 A 4/2011
CN 102124505 A 7/2011
CN 103258425 A 8/2013
CN 103942957 A 7/2014
CN 104282162 A 1/2015
CN 104648049 A 5/2015
CN 105474285 A 4/2016
DE 102013014872 A1 3/2015
JP 2008108033 A 5/2008
WO 2015134542 A 9/2015

* cited by examiner

ARRANGEMENT AND METHOD FOR PROVIDING ADAPTATION TO QUEUE LENGTH FOR TRAFFIC LIGHT ASSIST-APPLICATIONS

TECHNICAL FIELD

The present disclosure relates to a system for adapting traffic light assist applications of connected road vehicles to queue lengths at intersections within a road network having connected traffic lights.

The disclosure further relates to a method for adapting traffic light assist applications of connected road vehicles to queue lengths at intersections within a road network having connected traffic lights.

The disclosure further relates to a connected vehicle, traffic light assist applications of are adaptable to queue lengths at intersections within a road network having connected traffic lights.

BACKGROUND

Modern road vehicles and roadside infrastructure are ever increasingly being connected. This allows information from infrastructure to be relayed to road vehicles over e.g. a cellular network through cloud-based systems. In this way, connected road vehicles can gain access to the planned phase shifts of connected traffic lights, i.e. the remaining time till change of light phases (SPAT, Signal Phase and Time). Such information from the connected traffic lights enables in-vehicle applications, such as Time To Green, Green Light Optimized Speed Advisory and Red Light Violation Warning.

The Green Light Optimized Speed Advisory function reduces stop times and unnecessary acceleration in urban traffic situations to save fuel and reduce emissions. The provided speed advice helps to find the optimal speed to pass the next traffic lights during a green phase. In case it is not possible to provide a speed advice, the remaining Time To Green may be provided.

The Red Light Violation Warning function enables a connected road vehicle approaching an instrumented signalized intersection to receive information from the infrastructure regarding the signal timing and the geometry of the intersection. An application in the connected road vehicle normally uses its speed and acceleration profile, along with the signal timing and geometry information to determine if it appears likely that the connected road vehicle will enter the intersection in violation of a traffic signal. If the violation seems likely to occur, a warning can be provided to a driver of the connected road vehicle.

Thus, from the above it is clear that such new functions can benefit a connected road vehicle driver's convenience, transport efficiency and road safety.

Often, the variation in the traffic situation around a traffic light will affect how a vehicle driver relates to a traffic light. If there are no vehicles waiting at a red light the driver will approach the traffic light differently than if there are stationary vehicles lined up in a queue in front of a red light. Similarly, as a traffic light switches to green, the delta time to take off will differ if a vehicle is positioned first or last in the queue of vehicles waiting for the green light.

Thus there is a need for solutions to further improve traffic light assist applications of connected road vehicles by adapting it to other vehicle traffic around a traffic light at an intersection, as discussed above.

SUMMARY

Embodiments herein aim to provide an improved system for adapting traffic light assist applications of connected road vehicles to queue lengths at intersections within a road network having connected traffic lights arranged to relay information on their planned phase shifts to the connected road vehicles over a communications network through cloud-based systems containing a back-end logic.

This is provided through a system in which each respective connected vehicle comprises: a communication arrangement, arranged to communicate to the back-end logic a position of that connected vehicle when at standstill in a queue in front of a connected traffic light within the road network; and sensors for determining adjacent vehicles in front of or behind of that connected road vehicle when at standstill in a queue in front of a connected traffic light within the road network and providing to the back-end logic data relating to that determination, wherein the back-end logic is arranged to determine from the sensor data of the respective connected road vehicle if that connected road vehicle is located within a queue with other vehicles behind it or if it is the last vehicle in the queue without any vehicles behind it, and further to determine the length of the queue from that connected vehicle up to the connected traffic light within the road network, and further, if determined that that connected road vehicle is the last vehicle in the queue, to adapt traffic light assist applications of connected road vehicles approaching that connected traffic light within the road network to the thus determined length of the entire queue, and if determined that that connected road vehicle is located within a queue, to adapt traffic light assist applications of that connected road vehicle to the thus determined length of the queue in front thereof.

According to a second aspect is provided that if determined that that connected road vehicle is located within a queue with other vehicles behind it, the back-end logic is arranged to use a model of the probable backwards growing propagation of the queue to estimate the length of the entire queue, using as an input to the model traffic data acquired further upstream a road leading to that particular connected traffic light within the road network, and further to adapt traffic light assist applications of connected road vehicles approaching that particular connected traffic light within the road network to the thus estimated length of the entire queue.

The provision of using a model of the probable backwards growing propagation of the queue to estimate the length of the entire queue provides for estimating the length of the entire queue when the vehicles behind that connected road vehicle are non-connected vehicles.

According to a third aspect is provided that the back-end logic further is arranged to determine if a connected road vehicle arrives to the end of a queue, the entire length of which previously was estimated, and if determined that that connected road vehicle now is the last vehicle in the queue, adapt traffic light assist applications of connected road vehicles approaching that particular connected traffic light within the road network to an entire queue length being a determined length of the queue from that connected vehicle up to the connected traffic light within the road network and to test the back-end logic through comparing the estimated length of the entire queue with the determined length of the entire queue provided by the position data from that newly arrived connected road vehicle.

The provision of testing the back-end logic through comparing the estimated length of the entire queue with the determined length of the entire queue provided by the position data from that newly arrived connected road vehicle provides for assessing the quality of the logic providing the estimation.

According to a fourth aspect is provided that the back-end logic further is arranged to estimate the number of vehicles in a queue using an assumption that each vehicle occupies a pre-determined length of that queue.

The provision of estimating the number of vehicles in a queue using an assumption that each vehicle occupies a pre-determined length of that queue provides a simple and efficient way to estimate the number of vehicles in a queue of a certain length.

According to a fifth aspect is provided that the back-end logic further is arranged to estimate a time required to evacuate a queue of vehicles in front of a connected traffic light using the assumption that each vehicle occupies a pre-determined length of that queue and that it takes a pre-determined amount of time for each vehicle to evacuate that queue, and optionally to test the back-end logic through comparing the estimated time required to evacuate the queue with a determined time required to evacuate the entire queue derived from position data from a last vehicle in the queue during such evacuation.

The provision of estimating a time required to evacuate a queue of vehicles in front of a connected traffic light using the assumption that each vehicle occupies a pre-determined length of that queue and that it takes a pre-determined amount of time for each vehicle to evacuate that queue provides a simple and efficient way to estimate the time required to evacuate a queue of vehicles in front of a connected traffic light and the provision of testing the back-end logic as above provides for further assessing the quality of the logic providing the estimation.

According to a sixth aspect is provided that the back-end logic further is arranged to use data from the back-end logic testing to train a self-learning algorithm to provide improved estimates of at least one of the entire queue length and the time required to evacuate the entire queue.

The provision of using data from the back-end logic testing to train a self-learning algorithm enables it to provide improved estimates of the entire queue length and the time required to evacuate the entire queue, such that it will successively be able to better and better estimate these properties.

According to a seventh aspect is provided that the back-end logic further is arranged to adapt traffic light assist applications of a connected road vehicle approaching a queue up to a connected traffic light signaling red, to provide an optimal speed advisory for that connected road vehicle to avoid stopping behind the last vehicle in the queue by adapting to the position of the last vehicle in the queue and an expected time at which the last vehicle in the queue is expected to have evacuated the queue after the connected traffic light has turned green.

The provision of adapting to the position of the last vehicle in the queue and an expected time at which the last vehicle in the queue is expected to have evacuated the queue after the connected traffic light has turned green provides an efficient way of providing an optimal speed advisory for that connected road vehicle to avoid stopping behind the last vehicle in the queue.

Embodiments herein also aim to provide an improved method for adapting traffic light assist applications of connected road vehicles to queue lengths at intersections within a road network having connected traffic lights arranged to relay information on their planned phase shifts to the connected road vehicles over a communications network through cloud-based systems containing a back-end logic.

Thus, according to an eight aspect, this is provided through a method that comprises arranging each respective connected vehicle to: communicate to the back-end logic a position of that connected vehicle when at standstill in a queue in front of a connected traffic light within the road network using a communication arrangement; and determining adjacent vehicles in front of or behind of that connected road vehicle when at standstill in a queue in front of a connected traffic light within the road network using sensors of the connected road vehicle and providing to the back-end logic data relating to that determination, determining from the sensor data of the respective connected road vehicle if that connected road vehicle is located within a queue with other vehicles behind it or if it is the last vehicle in the queue without any vehicles behind it using the back-end logic, and further determining the length of the queue from that connected vehicle up to the connected traffic light within the road network, and further, if determined that that connected road vehicle is the last vehicle in the queue, adapting traffic light assist applications of connected road vehicles approaching that connected traffic light within the road network to the thus determined length of the entire queue, and if determined that that connected road vehicle is located within a queue, adapting traffic light assist applications of that connected road vehicle to the thus determined length of the queue in front thereof.

According to a ninth aspect is provided that if determined that that connected road vehicle is located within a queue with other vehicles behind it, using a model of the probable backwards growing propagation of the queue to estimate the length of the entire queue using the back-end logic, using as an input to the model traffic data acquired further upstream a road leading to that particular connected traffic light within the road network, and further adapting traffic light assist applications of connected road vehicles approaching that particular connected traffic light within the road network to the thus estimated length of the entire queue.

The provision of using a model of the probable backwards growing propagation of the queue to estimate the length of the entire queue provides for estimating the length of the entire queue when the vehicles behind that connected road vehicle are non-connected vehicles.

According to a tenth aspect is provided that the method further comprises determining if a connected road vehicle arrives to the end of a queue, the entire length of which previously was estimated, and if determined that that connected road vehicle now is the last vehicle in the queue, adapting traffic light assist applications of connected road vehicles approaching that particular connected traffic light within the road network to an entire queue length being a determined length of the queue from that connected vehicle up to the connected traffic light within the road network, and testing the back-end logic through comparing the estimated length of the entire queue with the determined length of the entire queue provided by the position data from that newly arrived connected road vehicle using the back-end logic.

The provision of testing the back-end logic through comparing the estimated length of the entire queue with the determined length of the entire queue provided by the position data from that newly arrived connected road vehicle provides for assessing the quality of the logic providing the estimation.

According to an eleventh aspect is provided that the method further comprises arranging the back-end logic to estimate the number of vehicles in a queue using an assumption that each vehicle occupies a pre-determined length of that queue.

The provision of estimating the number of vehicles in a queue using an assumption that each vehicle occupies a pre-determined length of that queue provides a simple and efficient way to estimate the number of vehicles in a queue of a certain length.

According to a twelfth aspect is provided that the method further comprises arranging the back-end logic to estimate a time required to evacuate a queue of vehicles in front of a connected traffic light using the assumption that each vehicle occupies a pre-determined length of that queue and that it takes a pre-determined amount of time for each vehicle to evacuate that queue, and optionally to test the back-end logic through comparing the estimated time required to evacuate the queue with a determined time required to evacuate the entire queue derived from position data from a last vehicle in the queue during such evacuation.

The provision of estimating a time required to evacuate a queue of vehicles in front of a connected traffic light using the assumption that each vehicle occupies a pre-determined length of that queue and that it takes a pre-determined amount of time for each vehicle to evacuate that queue provides a simple and efficient way to estimate the time required to evacuate a queue of vehicles in front of a connected traffic light and the provision of testing the back-end logic as above provides for further assessing the quality of the logic providing the estimation.

According to a thirteenth aspect is provided that the method further comprises using data from the back-end logic testing to train a self-learning algorithm to provide improved estimates of at least one of the entire queue length and the time required to evacuate the entire queue.

The provision of using data from the back-end logic testing to train a self-learning algorithm enables it to provide improved estimates of the entire queue length and the time required to evacuate the entire queue, such that it will successively be able to better and better estimate these properties.

According to an fourteenth aspect is provided that the method further comprises arranging the back-end logic to adapt traffic light assist applications of a connected road vehicle approaching a queue up to a connected traffic light signaling red, to provide an optimal speed advisory for that connected road vehicle to avoid stopping behind the last vehicle in the queue by adapting to the position of the last vehicle in the queue and an expected time at which the last vehicle in the queue is expected to have evacuated the queue after the connected traffic light has turned green.

The provision of adapting to the position of the last vehicle in the queue and an expected time at which the last vehicle in the queue is expected to have evacuated the queue after the connected traffic light has turned green provides an efficient way of providing an optimal speed advisory for that connected road vehicle to avoid stopping behind the last vehicle in the queue.

According to a final aspect is provided a connected road vehicle suitable for use with embodiments of systems as described herein and in accordance with embodiments of methods described herein.

A connected road vehicle, as above, comprises: a traffic light assist application adaptable to queue lengths at intersections within a road network having connected traffic lights arranged to relay information on their planned phase shifts to the connected road vehicles over a communications network through cloud-based systems containing a back-end logic, as described herein.

BRIEF DESCRIPTION OF THE DRAWINGS

In the following, embodiments herein will be described in greater detail by way of example only with reference to attached drawings, in which.

Still other objects and features of embodiments herein will become apparent from the following detailed description considered in conjunction with the accompanying drawings. It is to be understood, however, that the drawings are designed solely for purposes of illustration and not as a definition of the limits hereof, for which reference should be made to the appended claims. It should be further understood that the drawings are not necessarily drawn to scale and that, unless otherwise indicated, they are merely intended to conceptually illustrate the structures and procedures described herein.

DESCRIPTION OF EMBODIMENTS

If a connected road vehicle has access only to the planned changes of a connected traffic light but has no access to other traffic data, traffic light assist applications of connected road vehicles, e.g. implemented in the cloud or as in-vehicle applications or combinations thereof, will not be able to adapt to other vehicles, and will therefore only be able to optimize for traffic situations with no other vehicles or few other vehicles around the connected traffic light. Unfortunately, in reality this is seldom the case.

Thus, the present application is based on the insight that if a system would have access to relevant information related to other traffic around the traffic light, such cloud supported in-vehicle traffic light assist applications could be improved to optimize also for traffic situations when there is traffic around the connected traffic light.

Figure 1:
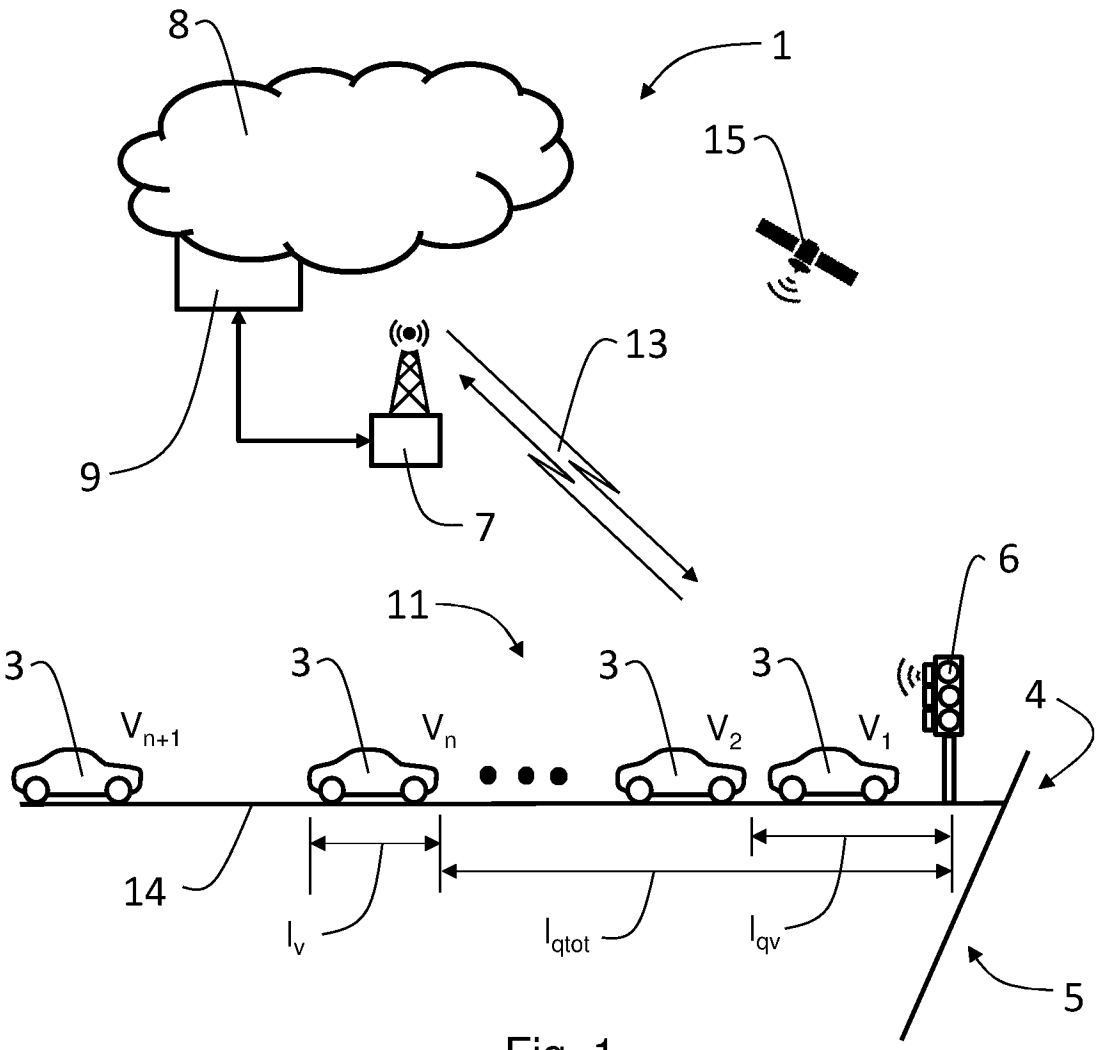
FIG. 1 is a schematic illustration of a system for adapting traffic light assist applications of connected road vehicles to queue lengths at intersections within a road network having connected traffic lights according to embodiments herein.

Thus, the present disclosure proposes, and illustrates in FIG. 1, a solution to provide an improved system 1 for adapting traffic light assist applications of connected road vehicles 3 to queue lengths at intersections 4 within a road network 5 having connected traffic lights 6. The connected traffic lights 6 are arranged to relay information on their planned phase shifts to the connected road vehicles 3 over a communications network 7 through cloud-based systems 8 containing a back-end logic 9.

Figure 3:
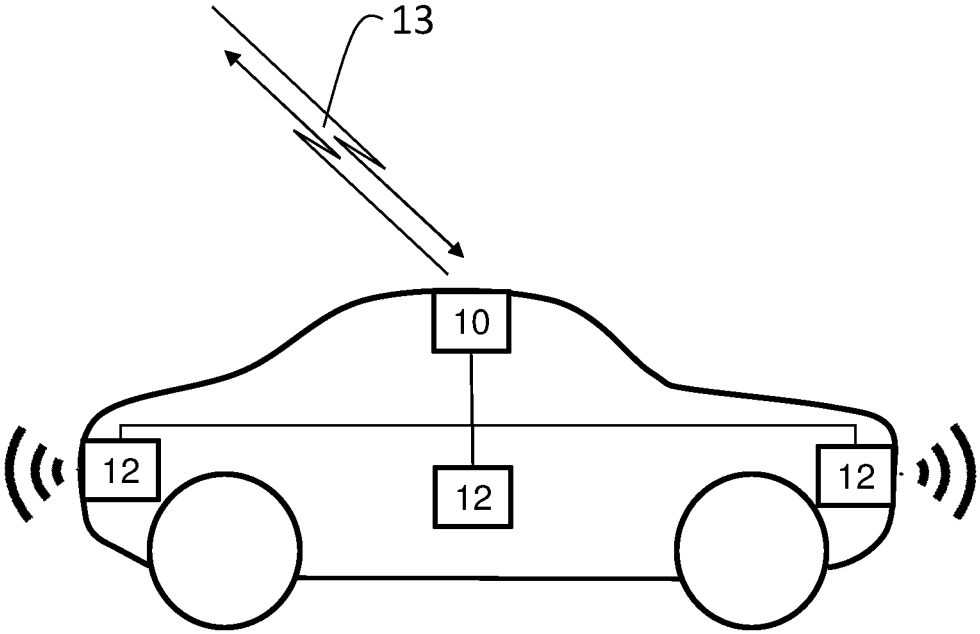
FIG. 3 is a schematic illustration of a connected road vehicle suitable for operation in a system and method according to embodiments herein.

This is provided through a system 1 in which each respective connected vehicle 3, as illustrated schematically in FIG. 3, comprises: a communication arrangement 10, arranged to communicate to the back-end logic 9 a position of that connected vehicle 3 when at standstill in a queue 11 of vehicles $V_1$-$V_n$ in front of a connected traffic light 6 within the road network 5; and sensors 12 for determining adjacent vehicles 3 in front of or behind of that connected road vehicle 3 when at standstill in a queue 11 in front of a connected traffic light 6 within the road network 5 and providing to the back-end logic 9 data relating to that determination.

Example sensors 12 that could be used include one or more of RADAR (RAdio Detection And Ranging) sensors, such as e.g. in a Blind spot Information System, active safety sensors or ultrasonic sensors for parking assist systems that could provide similar data. Other suitable sensors capable of determining adjacent vehicles in front of or behind of a connected road vehicle could be used as available, e.g. RADAR sensors, LASER (Light Amplification by Stimulated Emission of Radiation) sensors, LIDAR (Light Detection And Ranging) sensors, and/or imaging sensors, such as camera sensors, and any combination of such sensors, possibly also relying on sensor fusion.

The position of a respective connected road vehicle 3 may e.g. be provided from a respective positioning system 15, such as a satellite based GPS (Global Positioning System) or similar. The communication arrangement 10 may e.g. be an arrangement for wireless communication and in particular data communication over e.g. a cellular network 7 or similar, as illustrated by the broken arrows 13. This provides for cost efficient use of readily available and proven communications infrastructure. The communication arrangement 10 may be arranged to communicate with the back-end logic 9 to continuously report position data of the connected road vehicles 3 within the road network 5.

The back-end logic 9 is arranged to determine, from the sensor 12 data of the respective connected road vehicle 3, if that connected road vehicle 3 is located within a queue 11 with other vehicles behind it or if it is the last vehicle $V_n$ in the queue 11 without any vehicles behind it. It is further arranged to determine the length $l_{qv}$ of the queue 11 from that connected vehicle up to the connected traffic light 6 within the road network 5, exemplified in FIG. 1 as the length of the queue in front of the second vehicle $V_2$ of the queue.

If determined that that connected road vehicle 3 is the last vehicle $V_n$ in the queue 11, it is further arranged to adapt traffic light assist applications 2 of connected road vehicles $V_{n+1}$ approaching that connected traffic light 6 within the road network 5 to the thus determined length $l_{qtot}$ of the entire queue 11. Otherwise, if determined that that connected road vehicle 3 is located within a queue 11, e.g. the sensors 12 having determined adjacent vehicles in front of and behind of that connected road vehicle 3, to adapt traffic light assist applications 2 of that connected road vehicle 3 to the thus determined length $l_{qv}$ of the queue 11 in front thereof.

Thus, data from a fleet of connected road vehicles 3 can be used to accurately and cost efficiently adapt traffic light assist applications 2 of connected road vehicles 3 to queue 11 lengths at intersections 4 within a road network 5 having connected traffic lights 6.

Data may not always be available from the very last vehicle $V_n$ in the queue 11, e.g. when the last vehicle $V_n$ in the queue 11 is not connected to the back-end logic 9. In such cases, according to some embodiments, if determined that that connected road vehicle 3 is located within a queue 11 with other vehicles behind it, the back-end logic 9 is arranged to use a model of the probable backwards growing propagation of the queue 11 to estimate the length of the entire queue 11. Traffic data acquired further upstream a road 14 leading to that particular connected traffic light 6 within the road network 5, e.g. the traffic flow intensity further upstream on the road 14 leading to that connected traffic light 6, may be used as an input to the model for this estimation, enabling it to accurately estimate the queue 11. Traffic light assist applications 2 of connected road vehicles $V_{n+1}$ approaching that particular connected traffic light 6 within the road network 5 are then adapted to the thus estimated length $l_{qest}$ of the entire queue 11.

Using a model of the probable backwards growing propagation of the queue 11 to estimate the length $l_{qest}$ of the entire queue 11 makes it possible to estimate the length $l_{qest}$ of the entire queue 11, even if the vehicles behind that connected road vehicle 3 are non-connected vehicles.

In yet some embodiments the back-end logic 9 is further arranged to determine if a connected road vehicle 3 arrives to the end of a queue 11, the entire length $l_{qest}$ of which previously was estimated. If determined that that connected road vehicle 3 now is the last vehicle $V_n$ in the queue 11, the back-end logic 9 is further arranged to adapt traffic light assist applications 2 of connected road vehicles $V_{n+1}$ approaching that particular connected traffic light 6 within the road network 5 to an entire queue 11 length $l_{qtot}$ being a determined length $l_{qv}$ of the queue 11 from that connected vehicle 3 up to the connected traffic light 6 within the road network 5. Thus, whenever a connected road vehicle 3 arrives to the end of the queue 11 and slows down to a stop, the back-end logic 9 will again have exact data of the present length $l_{qtot}$ of the queue 11, i.e. defined by the distance along the road 14 between the position of the connected traffic light 6 and the position of the last vehicle $V_n$ in the queue 11. At each such moment, the system 1 is also arranged to test the back-end logic 9 through comparing the estimated length $l_{qest}$ of the entire queue 11 with the determined length $l_{qtot}$ of the entire queue 11 provided by the position data from that newly arrived connected road vehicle 3. Through testing the back-end logic 9, by comparing the estimated length $l_{qest}$ of the entire queue 11 with the determined length $l_{qtot}$ of the entire queue 11 provided by the position data from that newly arrived connected road vehicle 3, the quality of the back-end logic 9 providing the estimation can be assessed.

In yet other embodiments the back-end logic 9 is further arranged to estimate the number of vehicles in a queue 11 using an assumption that each vehicle occupies a pre-determined length $l_v$ of that queue 11. This provides a simple and efficient way to estimate the number of vehicles in a queue 11 of a certain length.

The length of a queue 11 is relevant to the effective time at which a road vehicle could take off after a traffic light 6 has switched from red to green. A longer queue 11 ahead would imply a longer delta time. The added delta time corresponds to the time that is required to evacuate the queue 11 of vehicles in front of a traffic light 6.

Thus, according to some further embodiments the back-end logic 9 is further arranged to estimate a time required to evacuate a queue 11 of vehicles in front of a connected traffic light 6. This time is estimated using the assumption that each vehicle occupies a pre-determined length of that queue 11 and that it takes a pre-determined amount of time for each vehicle evacuate that queue 11, and optionally to test the back-end logic 9 through comparing the estimated time required to evacuate the queue 11 with a determined time required to evacuate the entire queue 11 derived from position data from a last vehicle $V_n$ in the queue 11 during such evacuation. An estimation algorithm used could be linear or more advanced, depending on the specific implementation. Hereby is provided a simple and efficient way to estimate the time required to evacuate a queue 11 of vehicles in front of a connected traffic light 6.

In some still further embodiments the back-end logic 9 is further arranged to use data from the back-end logic 9 testing to train a self-learning algorithm to provide improved estimates of at least one of the entire queue length $l_{qest}$ and the time required to evacuate the entire queue 11. Using data from the back-end logic 9 testing to train a self-learning algorithm makes it possible to successively provide improved estimates of a present length $l_{qest}$ of an entire queue 11 as well as a time required to evacuate the entire queue 11.

In still further embodiments the back-end logic 9 is further arranged to adapt traffic light assist applications 2 of a connected road vehicle $V_{n+1}$ approaching a queue 11 up to a connected traffic light 6 signaling red, to provide an optimal speed advisory for that connected road vehicle 3 to avoid stopping behind the last vehicle $V_n$ in the queue 11 by adapting to the position of the last vehicle $V_n$ in the queue 11 and an expected time at which the last vehicle $V_n$ in the queue 11 is expected to have evacuated the queue 11 after the connected traffic light 6 has turned green. Such adaptation provides an efficient way of providing an optimal speed advisory for that connected road vehicle 3 to avoid stopping behind the last vehicle $V_n$ in the queue 11.

Hence, if the cloud back-end logic 9 and in-vehicle traffic light assist application 2 is made aware of the length of a queue 11 in front of a connected traffic light 6 signaling red, as above, it can adapt for both an off-set position and an added delta time. If there is a queue 11 in front of the connected traffic light 6 the GLOSA-application should ideally provide the optimal speed to avoid a short stop behind the last vehicle $V_n$ in the queue 11, i.e. adapt to the location of the last vehicle $V_n$ in the queue 11 and the expected time, including the delta time, at which the last vehicle $V_n$ in the queue 11 is expected to take off after the light turns green. In this way is rendered a different optimal speed that allows the GLOSA function to guide a driver also when there are other vehicles around the connected traffic light 6.

Also, if the cloud back-end logic 9 or in-vehicle traffic light assist application 2 have access to the length of the queue 11, both the SPAT message and the off-set position can be adjusted with the delta time and with the position of the end of the queue 11, respectively.

Furthermore, based on data from approaching vehicles, an algorithm used to calculate both the predicted added delta time and the estimated length $l_{qest}$ of the queue 11 can be monitored. The predicted added delta time and the estimated length $l_{qest}$ of the queue 11 can be monitored and compared to actual delta time and actual length $l_{qtot}$ of the queue 11 as inferred from the movements of connected vehicles 3 approaching the connected traffic light 6. Hence, it will be possible to monitor if the approaching vehicles moves according to the predicted queue 11.

Figure 2:
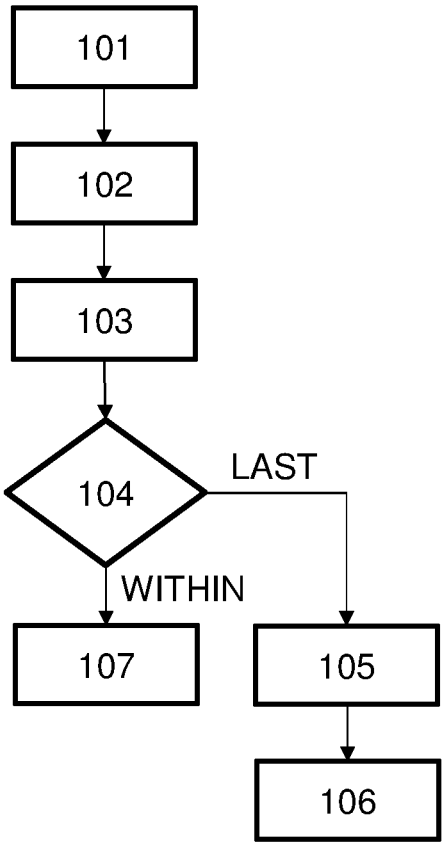
FIG. 2 is a schematic illustration of a method for adapting traffic light assist applications of connected road vehicles to queue lengths at intersections within a road network having connected traffic lights according to embodiments herein.

Embodiments herein also aim to provide an improved method, as illustrated schematically in FIG. 2, for adapting traffic light assist applications 2 of connected road vehicles 3 to queue 11 lengths at intersections 4 within a road network 5 having connected traffic lights 6 arranged to relay information on their planned phase shifts to the connected road vehicles 3 over a communications network 7 through cloud-based systems 8 containing a back-end logic 9.

This is provided through a method that comprises arranging each respective connected vehicle 3 to:

communicate 101 to the back-end logic a position of that connected vehicle when at standstill in a queue in front of a connected traffic light within the road network using a communication arrangement; and determining 102 adjacent vehicles 3 in front of or behind of that connected road vehicle 3 when at standstill in a queue 11 in front of a connected traffic light 6 within the road network 5 using sensors 12 of the connected road vehicle and providing 103 to the back-end logic 9 data relating to that determination.

The method further comprises determining 104 from the sensor data of the respective connected road vehicle 3 if that connected road vehicle 3 is located within a queue 11 with other vehicles behind it or if it is the last vehicle $V_n$ in the queue 11 without any vehicles behind it, using the back-end logic 9.

The method further also comprises determining 105 the length $l_{qv}$ of the queue 11 from that connected vehicle 3 up to the connected traffic light 6 within the road network 5. Further, if determined that that connected road vehicle 3 is the last vehicle $V_n$ in the queue 11, the method comprises adapting 106 traffic light assist applications 2 of connected road vehicles $V_{n+1}$ approaching that connected traffic light 6 within the road network 5 to the thus determined length $l_{qv}$ of the entire queue 11. Otherwise, if determined that that connected road vehicle 3 is located within a queue 11, the method comprises adapting 107 traffic light assist applications 2 of that connected road vehicle 3 to the thus determined length $l_{qv}$ of the queue 11 in front thereof. This, of course, as it is understood that the relevant length of the queue 11 for a certain specific vehicle 3 is the length $l_{qv}$ between the connected traffic light 6 and that specific vehicle 3. Thus, vehicles in the queue 11 behind that vehicle 3 are not relevant to this specific vehicle 3.

If determined that that connected road vehicle 3 is located within a queue 11 with other vehicles behind it, the method, according to embodiments herein, provides for using a model of the probable backwards growing propagation of the queue 11 to estimate the length of the entire queue 11, using the back-end logic 9. Traffic data acquired further upstream a road 14 leading to that particular connected traffic light 6 within the road network 5 is than used as an input to the model. Traffic light assist applications 2 of connected road vehicles $V_{n+1}$ approaching that particular connected traffic light 6 within the road network 5 is then adapted to the thus estimated length $l_{qest}$ of the entire queue 11.

By using a model of the probable backwards growing propagation of the queue 11 to estimate the length of the entire queue 11 is provided for estimating the length $l_{qest}$ of the entire queue 11 when the vehicles behind that connected road vehicle 3 are non-connected vehicles.

In yet some embodiments the method further comprises determining if a connected road vehicle 3 arrives to the end of a queue 11, the entire length $l_{qest}$ of which previously was estimated. If determined that that connected road vehicle 3 now is the last vehicle $V_n$ in the queue 11, the method comprises adapting traffic light assist applications of connected road vehicles $V_{n+1}$ approaching that particular connected traffic light 6 within the road network 5 to an entire queue 11 length $l_{qtot}$ being a determined length $l_{qv}$ of the queue 11 from that connected vehicle 3 up to the connected traffic light 6 within the road network 5. The method further comprises testing the back-end logic 9 through comparing the estimated length $l_{qest}$ of the entire queue 11 with the determined length $l_{qtot}$ of the entire queue 11 provided by the position data from that newly arrived connected road vehicle 3 using the back-end logic 9. This provides for assessing the quality of the back-end logic 9 providing the estimation.

According to still further embodiments the method further comprises arranging the back-end logic 9 to estimate the number of vehicles in a queue 11 using an assumption that each vehicle occupies a pre-determined length $l_v$ of that queue 11. This provides a simple and efficient way to estimate the number of vehicles in a queue 11 of a certain length.

The method in further embodiments comprises arranging the back-end logic 9 to estimate a time required to evacuate a queue 11 of vehicles in front of a connected traffic light 6 using the assumption that each vehicle occupies a pre-determined length $l_v$ of that queue 11 and that it takes a pre-determined amount of time for each vehicle evacuate that queue 11, and optionally to test the back-end logic 9 through comparing the estimated time required to evacuate the queue 11 with a determined time required to evacuate the entire queue 11 derived from position data from a last vehicle $V_n$ in the queue 11 during such evacuation.

This provides a simple and efficient way to estimate the time required to evacuate a queue 11 of vehicles in front of a connected traffic light 6.

The length of a queue 11 is also relevant for a road vehicle $V_{n+1}$ approaching a connected traffic light 6. The GLOSA (Green Light Optimal Speed Advisory) will normally propose an optimal speed for a road vehicle $V_{n+1}$ approaching a red light so that it can pass the position of the traffic light just after it has turned green—avoiding frequent short stops at red and the inconvenient and a fuel consuming driving pattern of repeated deceleration and acceleration.

In still some embodiments the method further comprises using data from the back-end logic 9 testing to train a self-learning algorithm to provide improved estimates of at least one of the entire queue length $l_{qest}$ and the time required to evacuate the entire queue 11. This enables the self-learning algorithm to provide improved estimates of the entire queue 11 length $l_{qest}$ and the time required to evacuate the entire queue 11, such that it will successively be able to better and better estimate these properties.

Therefore, in yet other embodiments the method further comprises arranging the back-end logic 9 to adapt traffic light assist applications 2 of a connected road vehicle $V_{n+1}$ approaching a queue 11 up to a connected traffic light 6 signaling red, to provide an optimal speed advisory for that connected road vehicle 3 to avoid stopping behind the last vehicle $V_n$ in the queue 11. This is done by adapting these traffic light assist applications 2 to the position of the last vehicle $V_n$ in the queue 11 and an expected time at which the last vehicle $V_n$ in the queue 11 is expected to have evacuated the queue 11 after the connected traffic light 6 has turned green. Hereby is achieved an efficient way of providing an optimal speed advisory for that connected road vehicle 3 to avoid stopping behind the last vehicle $V_n$ in the queue 11.

Finally there is provided a connected road vehicle 3, as illustrated in FIG. 3, suitable for use with embodiments of systems 1 as described herein and in accordance with embodiments of methods as described herein.

A connected road vehicle 3, as above, comprises: a communication arrangement 10, sensors 12 for determining adjacent vehicles 3 in front of or behind of that connected road vehicle 3 and a traffic light assist application 2 adaptable to queue 11 lengths at intersections 4 within a road network 5 having connected traffic lights 6 arranged to relay information on their planned phase shifts to the connected road vehicles 3 over a communications network 7 through cloud-based systems 8 containing a back-end logic 9, as described herein. The communication arrangement 10, further being arranged to communicate, as illustrated by the broken arrows 13, with the back-end logic 9.

Finally, the improvements to the cloud back-end logic 9 and in-vehicle traffic light assist applications 2 achieved though the solutions described herein will benefit connected road vehicles 3 as well as highly automated driving (HAD) by future autonomously driving vehicles. The system 1 solution will allow self-driving vehicles to safely and efficiently negotiate connected traffic lights 6 when there is other traffic, especially when there is a queue 11 of vehicles in front of such a connected traffic light 6.

The above-described embodiments may be varied within the scope of the following claims.

Thus, while there have been shown and described and pointed out fundamental novel features of the embodiments herein, it will be understood that various omissions and substitutions and changes in the form and details of the devices illustrated, and in their operation, may be made by those skilled in the art. For example, it is expressly intended that all combinations of those elements and/or method steps which perform substantially the same function in substantially the same way to achieve the same results are equivalent. Moreover, it should be recognized that structures and/or elements and/or method steps shown and/or described in connection with any disclosed form or embodiment herein may be incorporated in any other disclosed or described or suggested form or embodiment as a general matter of design choice.

The invention claimed is:

1. A system for causing in-vehicle traffic light assist applications of connected road vehicles to respond to queue lengths at intersections within a road network having connected traffic lights arranged to relay information on their planned phase shifts to the connected road vehicles over a communications network through cloud-based systems comprising back-end logic, wherein each respective connected road vehicle comprises:

an in-vehicle traffic light assist application integrated with the corresponding connected road vehicle;

a communication arrangement, arranged to communicate to the back-end logic a position of that connected vehicle when at standstill in a queue, of vehicles, in front of a connected traffic light within the road network; and sensors for determining adjacent vehicles in front of or behind of that connected road vehicle when at standstill in the queue in front of the connected traffic light within the road network and providing to the back-end logic sensor data relating to that determination, wherein the back-end logic is configured to determine from the sensor data of the respective connected road vehicle if that connected road vehicle is located within the queue with other vehicles behind it or if it is a last vehicle in the queue without any vehicles behind it, and further to determine a length of the queue from that connected vehicle up to the connected traffic light within the road network, and further, if determined that that connected road vehicle is the last vehicle in the queue, to send information to in-vehicle traffic light assist applications of connected road vehicles approaching that connected traffic light within the road network to respond to the determined length, wherein the determined length is an entire queue length, if determined that that connected road vehicle is located within the queue, to send information to the in-vehicle traffic light assist applications of that connected road vehicle to respond to the determined length of the queue in front thereof, wherein when the back-end logic causes the in-vehicle traffic light assist applications of the connected road vehicles to respond, the back-end logic causes the in-vehicle traffic light assist applications to receive information, over the communication network or the communication arrangement, which is associated with the determined length of the queue, and wherein the in-vehicle traffic light assist application is configured to provide information derived from the determined length of the queue, of vehicles, to a driver of the connected road vehicle or to an autonomous drive system of the connected road vehicle.

2. The system according to claim 1, wherein if determined that that connected road vehicle is located within the queue with the other vehicles behind it, the back-end logic is configured to use a model of the probable backwards growing propagation of the queue to estimate the length of the queue, using, as an input to the model, traffic data acquired further upstream a road leading to that particular connected traffic light within the road network, and further to cause the in-vehicle traffic light assist applications of the connected road vehicles approaching that particular connected traffic light within the road network to respond to the entire queue length.

3. The system according to claim 2, wherein the back-end logic further is configured to determine if a new connected road vehicle arrives to the end of the queue and if determined that the new connected road vehicle now is the last vehicle in the queue, cause the in-vehicle traffic light assist applications of the connected road vehicles approaching that particular connected traffic light within the road network, to respond to a new entire queue length being a determined length of the queue from the new connected vehicle up to the connected traffic light within the road network and to test the back-end logic through comparing the estimated length of the entire queue with the new entire queue length, obtained based on position data from the new connected road vehicle.

4. The system according to claim 1, wherein the back-end logic further is configured to estimate a number of vehicles in the queue using an assumption that each vehicle occupies a pre-determined length of that queue.

5. The system according to claim 4, wherein the back-end logic further is configured to estimate a time required to evacuate the queue of vehicles in front of the connected traffic light using the assumption that each vehicle occupies the pre-determined length of that queue and that it takes a pre-determined amount of time for each vehicle to evacuate that queue, and optionally to test the back-end logic through comparing the determined time required to evacuate the queue with a second time required to evacuate the entire queue, wherein the second time is derived from position data from a last vehicle in the queue during such evacuation.

6. The system according to claim 3, wherein the back-end logic further is configured to use data from the back-end logic testing to train a self-learning algorithm to provide improved estimates of at least one of the entire queue length and time required to evacuate the entire queue.

7. The system according to claim 5, wherein the back-end logic further is configured to cause an in-vehicle traffic light assist application of a new connected road vehicle approaching the queue up to the connected traffic light, which is signaling red, to provide an optimal speed advisory for the new connected road vehicle to avoid stopping behind a last vehicle in the queue by responding to a position of the last vehicle in the queue and an expected time at which the last vehicle in the queue is expected to have evacuated the queue after the connected traffic light turns green.

8. A method for causing in-vehicle traffic light assist applications of connected road vehicles to respond to queue lengths at intersections within a road network having connected traffic lights arranged to relay information on their planned phase shifts to the connected road vehicles over a communications network through cloud-based systems containing back-end logic, wherein the method comprises:

arranging each respective connected vehicle to communicate to the back-end logic a position of that connected vehicle when at standstill in a queue, of vehicles, in front of a connected traffic light within the road network using a communication arrangement;

determining adjacent vehicles in front of or behind of that connected road vehicle when at standstill in the queue in front of the connected traffic light within the road network using sensors of the connected road vehicle and providing to the back-end logic sensor data relating to that determination;

determining from the sensor data of the respective connected road vehicle if that connected road vehicle is located within the queue with other vehicles behind it or if it is a last vehicle in the queue without any vehicles behind it using the back-end logic;

determining a length of the queue from that connected vehicle up to the connected traffic light within the road network; and if determined that that connected road vehicle is the last vehicle in the queue, causing in-vehicle traffic light assist applications of connected road vehicles approaching that connected traffic light within the road network to respond to the determined length wherein the determined length is an entire queue length, and if determined that that connected road vehicle is located within the queue, causing in-vehicle traffic light assist applications of that connected road vehicle to respond to the determined length of the queue in front thereof, wherein each of the connected road vehicles comprises the in-vehicle traffic light assist application integrated with the respective connected road vehicle wherein causing the in-vehicle traffic light assist applications to respond includes the back-end logic causing the in-vehicle traffic light assist applications to receive information, over the communication network or the communication arrangement, which is associated with the determined length of the queue, and wherein each of the in-vehicle traffic light assist application is configured to provide information derived from the determined length of the queue, of vehicles, to a driver of the respective connected road vehicle or to an autonomous drive system of the respective connected road vehicle.

9. The method according to claim 8, wherein if determined that that connected road vehicle is located within the queue with the other vehicles behind it, using a model of the probable backwards growing propagation of the queue to estimate the length of the entire queue using the back-end logic, using, as an input to the model, traffic data acquired further upstream a road leading to that particular connected traffic light within the road network, and further causing the in-vehicle traffic light assist applications of the connected road vehicles approaching that particular connected traffic light within the road network to respond to the entire queue length.

10. The method according to claim 9, further comprising:

determining if a new connected road vehicle arrives to the end of the queue and if determined that the new connected road vehicle now is the last vehicle in the queue, causing the in-vehicle traffic light assist applications of the connected road vehicles approaching that particular connected traffic light within the road network to respond to a new entire queue length being a determined length of the queue from the new connected vehicle up to the connected traffic light within the road network, and testing the back-end logic through comparing the estimated length of the entire queue with the new entire queue length, obtained based on position data from the new connected road vehicle using the back-end logic.

11. The method according to claim 8, further comprising:

configuring the back-end logic to estimate a number of vehicles in the queue using an assumption that each vehicle occupies a pre-determined length of that queue.

12. The method according to claim 11, further comprising:

configuring the back-end logic to estimate a time required to evacuate the queue of vehicles in front of the connected traffic light using the assumption that each vehicle occupies the pre-determined length of that queue and that it takes a pre-determined amount of time for each vehicle to evacuate that queue, and optionally testing the back-end logic through comparing the determined time required to evacuate the queue with a second time required to evacuate the entire queue, wherein the second time is derived from position data from a last vehicle in the queue during such evacuation.

13. The method according to claim 10, further comprising:

using data from the back-end logic testing to train a self-learning algorithm to provide improved estimates of at least one of the entire queue length and time required to evacuate the entire queue.

14. The method according to claim 12, further comprising:

configuring the back-end logic to cause an in-vehicle traffic light assist application of a new connected road vehicle approaching the queue up to the connected traffic light, which is signaling red, to provide an optimal speed advisory for that connected road vehicle to avoid stopping behind a last vehicle in the queue by responding to a position of the last vehicle in the queue and an expected time at which the last vehicle in the queue is expected to have evacuated the queue after the connected traffic light turns green.

15. A device that includes back-end logic for causing in-vehicle traffic light assist applications of connected road vehicles to respond to queue lengths at intersections within a road network having connected traffic lights configured to relay information on their planned phase shifts to the connected road vehicles over a communications network, wherein the back-end logic is configured to:

determine from sensor data of the respective connected road vehicle if that connected road vehicle is located within a queue, of vehicles, with other vehicles behind it or if it is a last vehicle in the queue without any vehicles behind it, determine a length of the queue from that connected vehicle up to the connected traffic light within the road network, and if determined that that connected road vehicle is the last vehicle in the queue, to cause in-vehicle traffic light assist applications of connected road vehicles approaching that connected traffic light within the road network to respond to a determined length of the entire queue, and if determined that that connected road vehicle is located within the queue, to cause an in-vehicle traffic light assist application of that connected road vehicle to respond to the determined length of the queue in front thereof, wherein causing the in-vehicle traffic light assist applications to respond includes the back-end logic causing the in-vehicle traffic light assist applications to receive information, over the communication network, which is associated with the determined length of the queue, and wherein each of the connected road vehicles comprises the in-vehicle traffic light assist application that is integrated with the respective connected road vehicle and is configured to provide information derived from the determined length of the queue, of vehicles, to a driver of the respective connected road vehicle or to an autonomous drive system of the respective connected road vehicle.

* * * * *